US005943702A

United States Patent [19]

Kronenberger

[11] Patent Number: 5,943,702

[45] Date of Patent: Aug. 31, 1999

[54] HEADWEAR PIECE WITH CHANGEABLE APPEARANCE

[75] Inventor: Robert Kronenberger, Deerfield, Ill.

[73] Assignee: American Needle, Buffalo Grove, Ill.

[21] Appl. No.: 08/601,305

[22] Filed: Feb. 16, 1996

[51] Int. Cl.[6] ..... A42B 1/24

[52] U.S. Cl. ..... 2/171.1; 2/195.1; 2/209.12; 2/244; 40/329

[58] Field of Search ..... 2/171.1, 195.1, 2/209.11, 209.12, 244, 246; 40/329

[56] References Cited

U.S. PATENT DOCUMENTS 4,985,935 1/1991 Hur ..... 2/195.1
5,253,368 10/1993 Blake ..... 2/195.1
5,373,586 12/1994 Brosnan ..... 2/195.1
5,379,461 1/1995 Wilmers ..... 2/246
5,454,120 10/1995 Rowlands ..... 2/195.1

*Primary Examiner*—Diana L. Oleksa
*Attorney, Agent, or Firm*—Wood, Phillips, VanSanten, Clark & Mortimer

[57] ABSTRACT

A headwear piece having a body with an opening to accept the head of a wearer. The body has an exposed external surface. An element defines at least a part of the exposed external surface of the body. Frangible structure connects the element to the body so that the frangible structure can be ruptured to at least partially separate the element from the body.

15 Claims, 7 Drawing Sheets

HEADWEAR PIECE WITH CHANGEABLE APPEARANCE

BACKGROUND OF THE INVENTION

1. Field of the Invention

This invention relates to headwear, such as baseball-style caps and, more particularly, to headwear having an external surface, the appearance of which can be selectively changed by the end user thereof. The invention is also directed to a method of changing the ornamental appearance of the headwear.

2. Background Art

Baseball-style caps are becoming increasingly popular. These caps are worn not only by baseball players but as casual wear by all age groups and both sexes. One need only visit a sporting goods store to see the wide range of ornamentation being offered on this type of headwear and the large number of companies offering such headwear.

As the consumer demand and the number of participants in the manufacture of such headwear increase, there becomes an increasing need to offer headwear that is different and appealing to the consumer.

SUMMARY OF THE INVENTION

In one form of the invention, a headwear piece is provided having a body with an opening to accept the head of a wearer. The body has an exposed external surface. An element defines at least a part of the exposed external surface of the body. Frangible structure connects the element to the body so that the frangible structure can be ruptured to at least partially separate the element from the body.

The external surface may be defined at least partially by a first fabric layer, with the frangible structure being a weakening in the first fabric layer to cause the fabric in the first layer to tear in a predetermined manner.

The weakening may be defined by a cut extending at least partially through the first fabric layer, by perforations, or in another suitable manner.

In one form, a second layer underlies the first fabric layer and there is at least one of a) writing, b) a scene, c) a logo, and d) discrete ornamentation on the second layer that is exposed as the element is at least partially separated from the body. The same type of a) writing, b) scene, c) logo, and d) discrete ornamentation can be provided on the element. Accordingly, with the element in one state, ornamentation thereon can be fully visible. With the element partially separated from the rest of the body, the ornamentation on the second layer can be wholly or partially visible.

In one form, the frangible structure, once ruptured, allows the element to be fully separated from the body.

In one form, the body has a cup-shaped crown defining the opening for the head of a wearer and the element is at least partially on the cup-shaped crown.

In another form, the headwear piece is a baseball-style cap having a body defined by a cup-shaped crown and a bill/visor connected to and projecting away from the cup-shaped crown, and the element is at least partially on the bill/visor.

In another form of the invention, a headwear piece is provided having a body defining an opening to accept the head of a wearer, which body has an exposed external surface defined by a first layer and a second layer underlying the first layer. At least a first part of the first layer is connected to the body so that the at least first part is at least partially separable from the body to thereby expose the second part of the second layer to view.

One or both of the at least first part and second part may have thereon at least one of a) writing, b) a scene, c) a logo, and d) discrete ornamentation.

Alternatively, the at least first part and second part have different colors.

The invention also contemplates a method of changing the appearance of a headwear piece, which method includes the steps of providing a headwear piece having a body defining an opening to accept the head of a wearer with the body having a first layer defining an exposed surface and a second layer underlying the first layer, and separating at least a part of the first layer from the body by tearing the first layer to expose the second layer.

The method may further include the step of weakening the first layer to cause the first layer to tear in a predetermined manner.

DETAILED DESCRIPTION OF THE DRAWING

Figure 1:
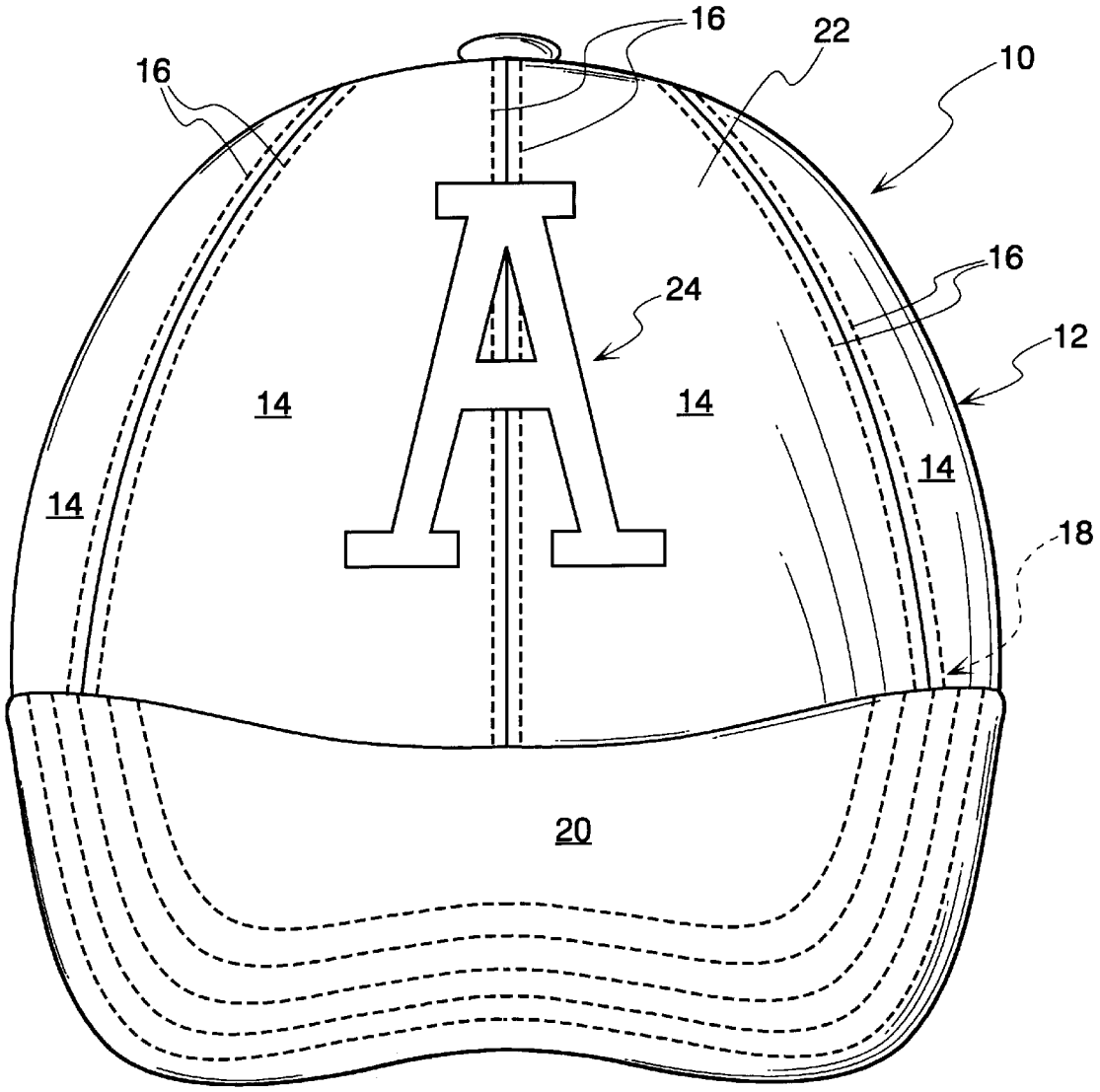
FIG. 1 is a front elevation view of a conventional baseball-style cap.
Figure 2:
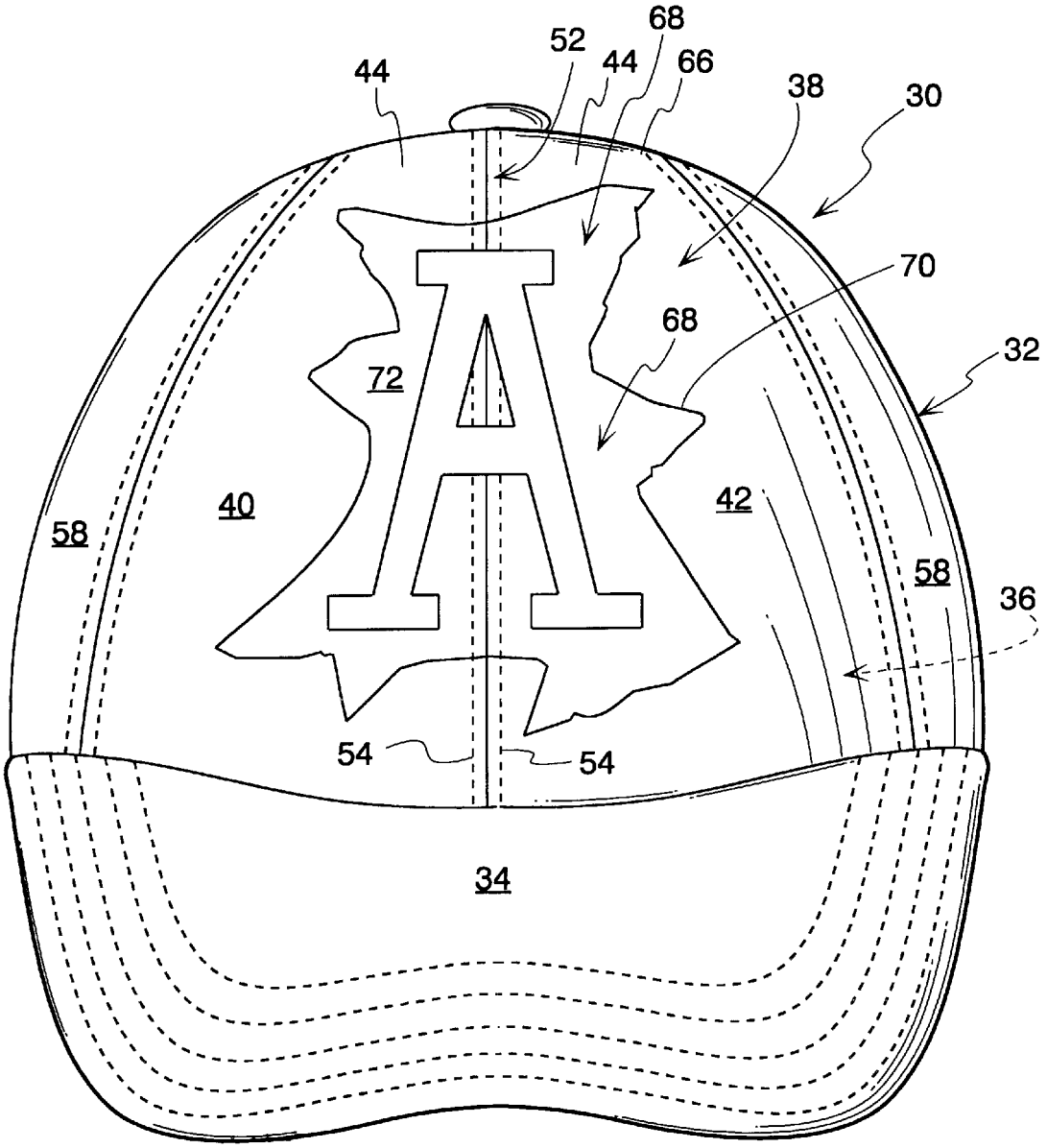
FIG. 2 is a front elevation view of a baseball-style cap with a separable element, according to the present invention, incorporated therein at the front of a crown.

In FIG. 1, a prior art baseball-style cap/headwear piece is shown at 10. The headwear piece 10 has a continuous crown 12 defined by a plurality of triangularly-shaped gores 14 which are joined by lines 16 of stitching in edge-to-edge relationship to produce an inverted, cup-shaped configuration and define an opening 18 to accept the head of a wearer. A bill/visor 20 connects to, and projects forwardly away from the crown 12.

On the external surface 22 of the crown 12, ornamentation at 24 is attached. In this case, the ornamentation 24 is located at the front of the crown 12. The ornamentation 24 is normally permanently attached, as by stitching or an adhesive.

In FIGS. 2–4 and 11, a baseball-style headwear piece/cap, according to the invention, is shown at 30 and has an inverted, cup-shaped crown 32 with a bill/visor 34 connected to, and projecting forwardly away from, the crown 32. The crown 32 defines a continuous opening 36 at the bottom thereof to accept the head of a wearer in a conventional fashion. The crown 32 and bill/visor 34 cooperatively define a unitary body.

In this form of the invention, the front 38 of the crown 32 is defined by similarly shaped gores 40, 42. Whereas the conventional headwear piece 10 is normally defined by gores 14 made from a single layer of cloth, the gores 40, 42 are each defined by an outer, first fabric layer 44 and an underlying, second fabric layer 48. The gores 40, 42, each consisting of the two layers 44, 48, are joined in edge-to-edge relationship, as are conventional gores. The outer layer 44 of the gores 40, 42 is joined along a seam 52 through parallel lines of stitching 54. The underlying layer 48 of the gores 40, 42 is joined along a seam 55, that underlies the seam 52, through parallel lines of stitching 56. The layers 44, 48 preferably are not joined to each other at the seams 52, 55. The gores 40, 42 are joined to adjacent gores 58 in conventional fashion.

In this form of the invention, a logo/letter 60 is applied to the forwardly facing surface 62 of the layer 48 by any conventional means i.e. sewing, adhesive, etc. It is to be understood that while a logo/letter is shown, this is only exemplary of other types of ornamentation contemplated by the invention. For example, the applied ornamentation 60 can be writing, a scene, another type of logo, or discrete ornamentation.

The external surface 66 of the first layer 44 at the front of the crown 32 has a second logo/letter 68 that is preferably different in appearance than the originally described logo 60. Again, the ornamentation 68 could be in the nature of writing, a scene, or other type of discrete ornamentation. The logo/letter 68 is incorporated into the first layer 44 preferably by an adhesive so that the connecting structure for the logo/letter 68 does not extend into the underlying layer 48.

Figure 8:
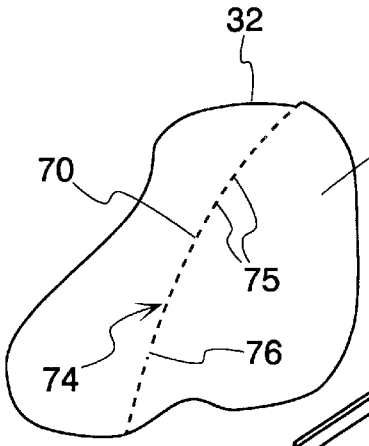
FIG. 8 is a fragmentary, front elevation view of a layer on the cap in FIGS. 2–4 with perforations therein to define the element and facilitate its separation from the crown.

According to the invention, the first layer 44 has a weakening line 70 that encloses an element 72 defined by a part of the first layer 44 and logo 68, and which is separable from the crown 32. One manner of defining this weakening line 70 is shown in FIG. 8. In FIG. 8, perforations 74 are defined by spaced cuts 75 extending fully through the layer 44 with weakened, frangible, fabric portions 76 between the cuts 75 to facilitate tearing of the element away from the crown 32 along the predetermined line 70.

Figure 9:
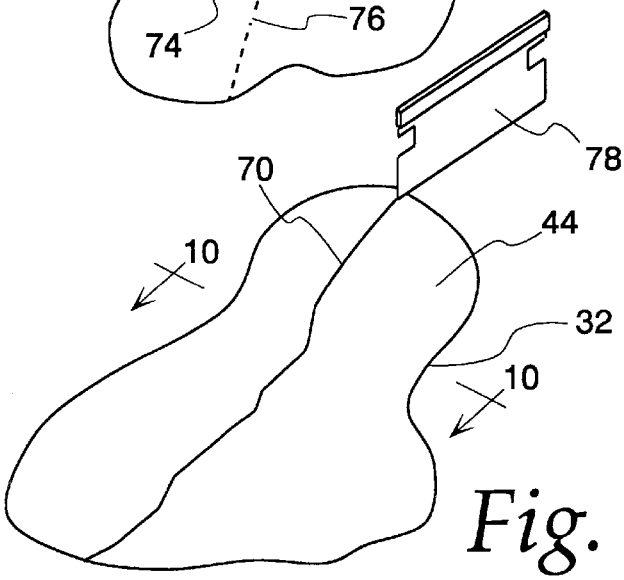
FIG. 9 is a fragmentary, front elevation view of a layer on the cap in FIGS. 2–4 being weakened by cutting partially therethrough to facilitate separation of the element from the crown.
Figure 11:
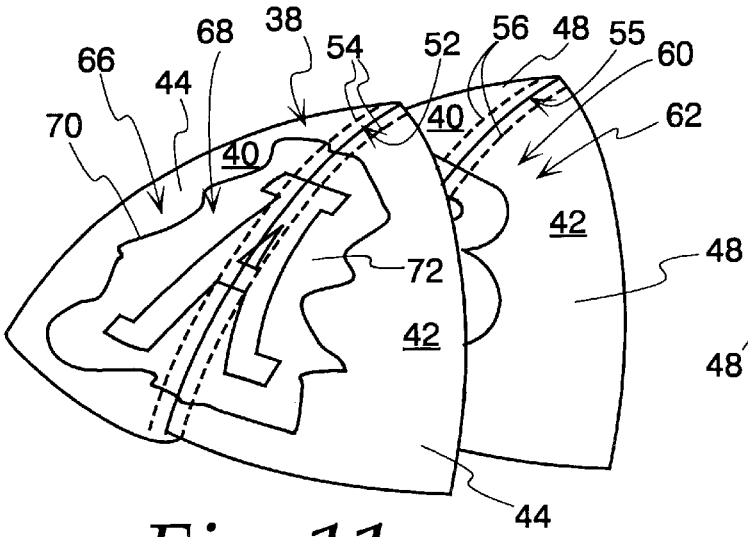
FIG. 11 is an exploded, perspective view of overlying and underlying layers used to define the front of the crown on the cap in FIGS. 2–4.
Figure 10:
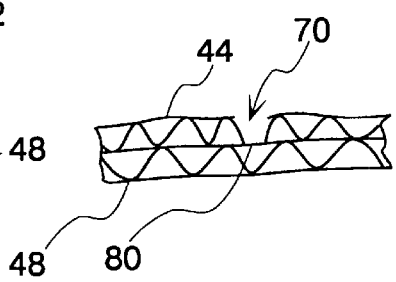
FIG. 10 is an enlarged, cross-sectional view of the partially cut layer and an underlying layer taken along line 10—10 of FIG. 9.

Alternatively, as shown in FIGS. 9 and 10, the layer 44 can be cut partially therethrough, as with a razor 78. With this arrangement, individual threads 80 bridge the line 70 and remain intact to maintain the element 72 on the crown 32 and are frangible and readily broken to facilitate separation of the element 72.

With the above arrangements, the parts 76 between cuts 75 and uncut threads 80 define frangible means connecting the element 72 to the crown 32.

Figure 3:
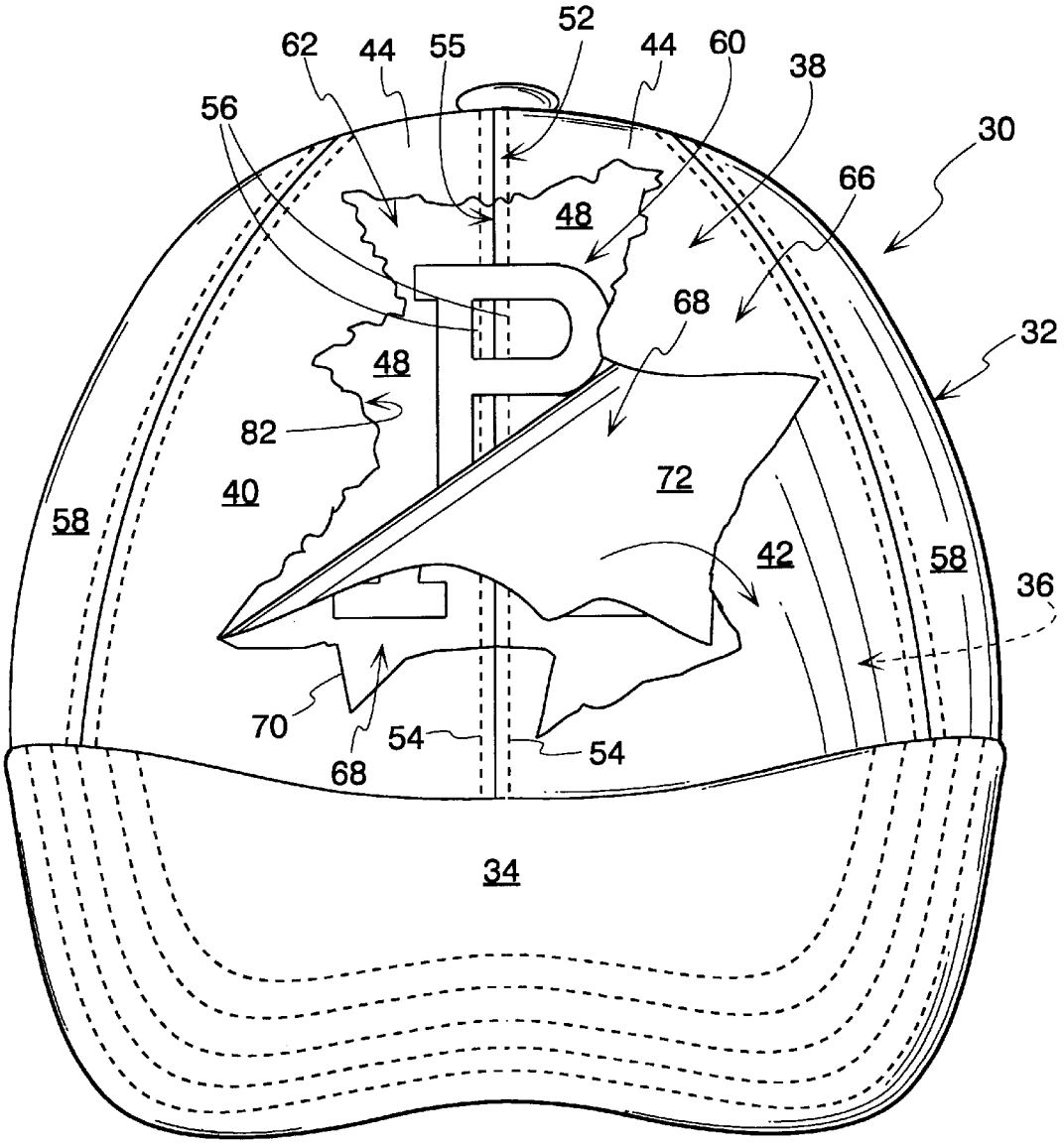
FIG. 3 is a view as in FIG. 2 with the element partially separated from the crown.
Figure 4:
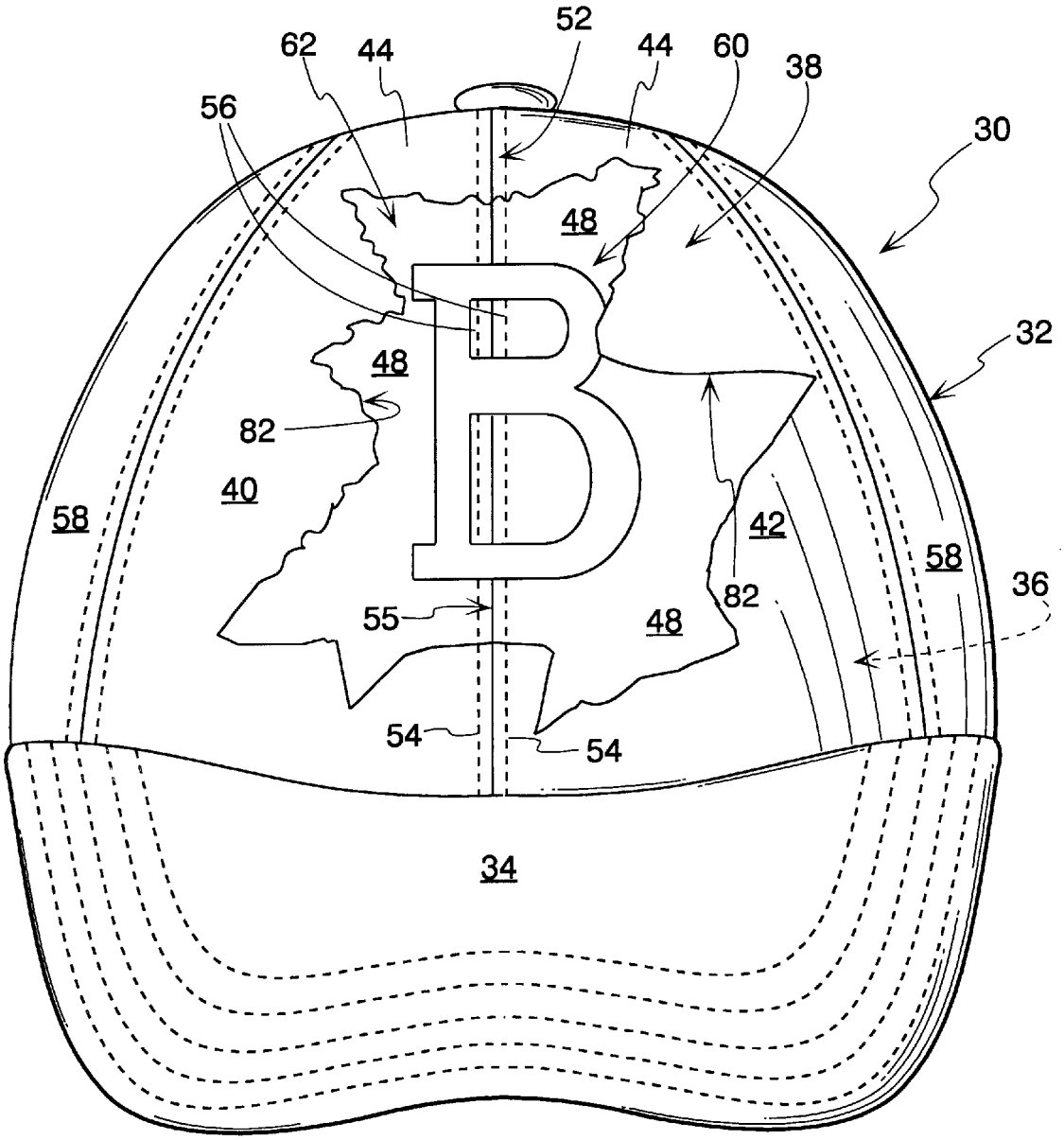
FIG. 4 is a view as in FIGS. 2 and 3 with the element fully separated from the crown.

When the manufacturer or end user wishes to change the appearance of the headwear 30, he/she grasps the element 72 and progressively tears the element 72 to separate the element 72 from the crown 32. In FIG. 3, the element 72 is shown partially torn away/separated to reveal the underlying logo 60. In FIG. 4, the element 72 is completely torn away/separated from the crown 32 so that the underlying logo 60 is fully exposed.

In this embodiment, the weakening line 70 is formed in a random, zig-zag shape. Once the element 72 is separated, a jagged edge 82 remains and frames the logo 60. This gives a torn look to the cap that is unique and visually appealing.

The manufacturer and/or user are given the opportunity to change the ornamental appearance of the headwear piece 30. The manufacturer and/or user also have the option of leaving the original ornamentation on the headwear piece 30 without removing the element 72.

The invention also contemplates several variations of this basic concept. For example, ornamentation can be provided on the element 72 but not on the underlying layer 48. The same ornamentation can be provided on both layers 44, 48. Alternatively, the element 72 can be made without ornamentation, with there being ornamentation only on the underlying layer 48. As a still further alternative, there may not be any discrete ornamentation on either layer, but instead the layers 44, 48 could be made with different coloring.

It is also possible to form the weakening line 70 so that it does not extend continuously around the element 72. In this way, the element 72 can be partially torn and left on the crown 32 to give the headwear piece 30 a desired, ragged appearance.

Figure 5:
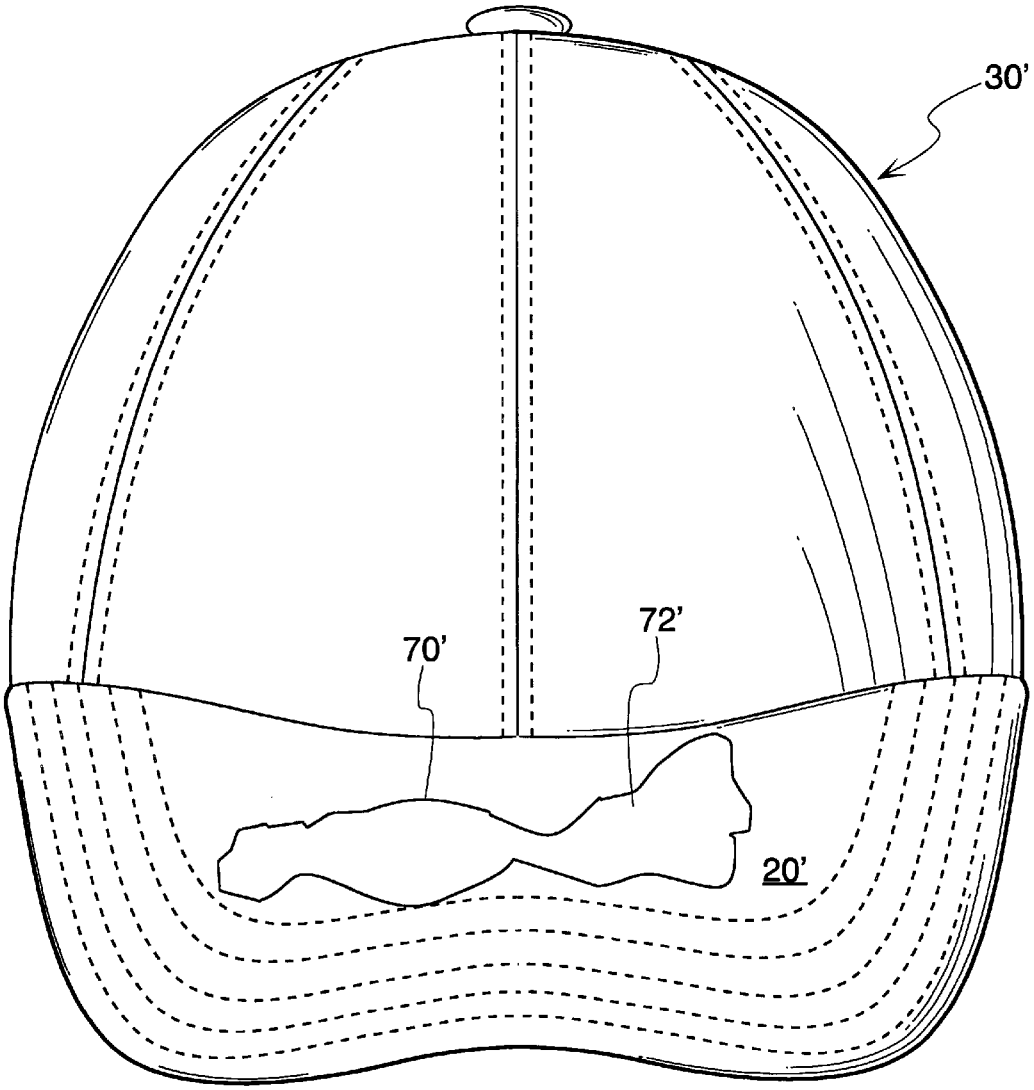
FIG. 5 is a front elevation view of a baseball-style cap with a separable element, according to the present invention, incorporated into a bill/visor.

The same basic concept can be employed other than at the front of the headwear piece 30. For example, in FIG. 5 an element 72' is attached to a bill/visor 20' of a headwear piece 30' that is in all material respects the same as the headwear piece 30. The element 72' can be joined to the bill/visor 20' and separated by tearing along a weakening line 70'.

Figure 6:
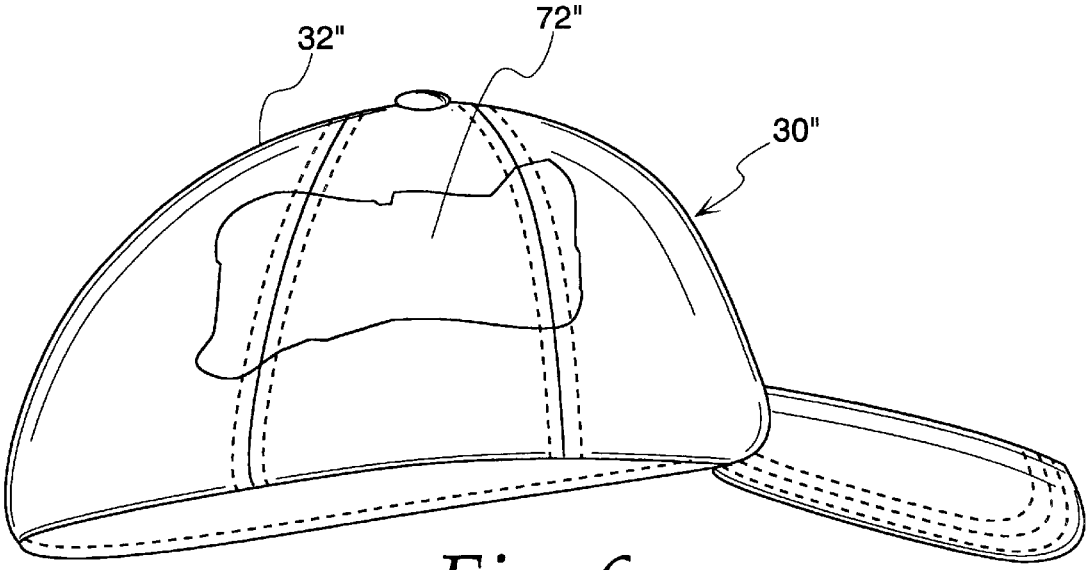
FIG. 6 is a side elevation view of a baseball-style cap with a separable element, according to the present invention, incorporated into the side of a crown.

In FIG. 6, an element 72" is attached to the side of a crown 32" on a headwear piece 30", corresponding to the headwear piece 30, in a manner to be separated/torn therefrom.

Figure 7:
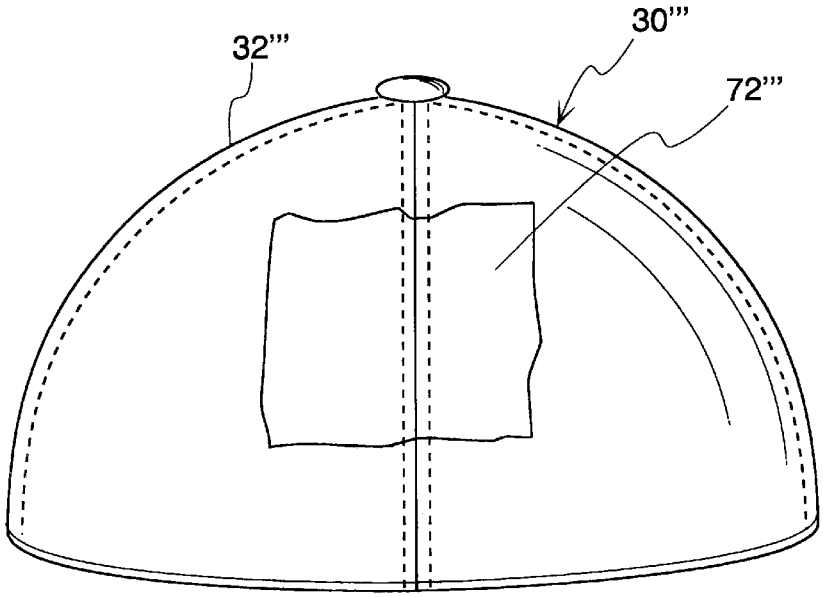
FIG. 7 is a rear elevation view of a baseball-style cap incorporating a separable element, according to the present invention, at the rear of a crown.

In a further variation, in FIG. 7, an element 72'" is attached at the rear of a crown 32'" on a headwear piece 30'", corresponding to the headwear piece 30, previously described, in a manner to be separated/torn therefrom.

It should be understood that the inventive concept can be employed on other types of headwear. The baseball-style cap described is only exemplary. For example, the concept could be employed on visors, including those that extend fully around a wearer's head and those that extend only partially around and biasably engage the sides of the wearer's head.

The foregoing disclosure of specific embodiments is intended to be illustrative of the broad concepts comprehended by the invention.

I claim:

1. A headwear piece comprising:

a body defining an opening to accept the head of a wearer, said body having an exposed external surface; and an element defining a part of the body and at least a part of the exposed external surface of the body, wherein the element is connected to another part of the body through a frangible connection which can be ruptured to at least partially separate the element from the another part of the body, wherein the external surface is defined at least partially by a first fabric layer and the frangible connection comprises a weakening in the first fabric layer to cause the fabric in the first layer to tear in a predetermined manner.

2. The headwear piece according to claim 1 wherein the weakening comprises a cut extending at least partially through the first fabric layer.

3. The headwear piece according to claim 1 wherein the weakening comprises perforations in the first fabric layer.

4. The headwear piece according to claim 1 wherein the body comprises a second layer underlying the first fabric layer and there is at least one of a) writing, b) a scene, c) a logo, and d) discrete ornamentation on the second layer that is exposed as the element is at least partially separated from the body.

5. The headwear piece according to claim 4 wherein there is at least one of a) writing, b) a scene, c) a logo, and d) discrete ornamentation on the element.

6. The headwear piece according to claim 1 wherein the frangible connection is configured to be ruptured to fully separate the element from the body.

7. The headwear piece according to claim 1 wherein the body comprises a cup-shaped crown defining the opening for the head of a wearer and the element is at least partially on the cup-shaped crown.

8. The headwear piece according to claim 1 wherein the headwear piece is a baseball style cap and the body comprises a cup-shaped crown and a bill/visor connected to and projecting away from the cup-shaped crown and the element is at least partially on the bill/visor.

9. A headwear piece comprising:

a body defining an opening to accept the head of a wearer, said body comprising an exposed external surface defined by a first layer and a second layer underlying the first layer, there being a first part of the first layer defining a first part of the body that is at least partially separable from another part of the body to thereby expose a second part of the second layer to view, wherein the second part of the second layer has at least one of a) writing, b) a scene, c) a logo, and d) discrete ornamentation thereon that is exposed to view with the at least first part of the first layer at least partially separated from the body, wherein there is at least one of a) writing b) a scene, c) a logo, and d) discrete ornamentation on the at least first part of the first layer.

10. The headwear piece according to claim 9 wherein the at least first part of the first layer has a first color and the second part of the second layer has a second color that is different than the first color.

11. A headwear piece comprising:

a body defining an opening to accept the head of a wearer, said body comprising an exposed external surface defined by a first layer and a second layer underlying the first layer, there being a first part of the first layer defining a first part of the body that is at least partially separable from another part of the body to thereby expose a second part of the second layer to view, wherein the second part of the second layer has at least one of a) writing, b) a scene, c) a logo, and d) discrete ornamentation thereon that is exposed to view with the at least first part of the first layer at least partially separated from the body, wherein the first part of the first layer is connected to the another part of the body through a frangible connection that can be ruptured to at least partially separate the at least first part of the first layer from the another part of the body, wherein the first layer comprises fabric and the frangible connection comprises a weakening in the fabric.

12. The headwear piece according to claim 11 wherein the weakening is defined by a cut extending only partially through the fabric.

13. The headwear piece according to claim 11 wherein the weakening is defined by perforations.

14. A method of changing the appearance of a headwear piece, said method comprising the steps of:

providing a headwear piece comprising a body defining an opening to accept the head of a wearer, with the body having a first layer defining an exposed surface and a second layer underlying the first layer; and separating at least a part of the first layer from the body by tearing the first layer to expose the second layer.

15. The method of changing the appearance of a headwear piece according to claim 14 including the step of weakening the first layer to cause the first layer to tear in a predetermined manner.

* * * * *